United States Patent [19]

Tomaszewski

[11] 4,233,124

[45] Nov. 11, 1980

[54] ELECTROLYTIC STRIPPING BATH AND PROCESS

[75] Inventor: Lillie C. Tomaszewski, Dearborn, Mich.

[73] Assignee: Oxy Metal Industries Corporation, Warren, Mich.

[21] Appl. No.: 89,059

[22] Filed: Oct. 29, 1979

[51] Int. Cl.[3] ..... C25F 5/00; C25F 3/02

[52] U.S. Cl. ..... 204/146; 204/129.95

[58] Field of Search ..... 204/146, 129.85, 129.95

[56] References Cited

U.S. PATENT DOCUMENTS

| | | | |
|---|---|---|---|
| 3,492,210 | 1/1970 | Bowers | 204/146 |
| 3,617,456 | 11/1971 | Dillenberg | 204/146 |
| 3,619,390 | 11/1971 | Dillenberg | 204/146 |
| 3,649,489 | 3/1972 | Dillenberg | 204/146 |
| 3,793,172 | 2/1974 | Cadieux | 204/146 |
| 3,912,603 | 10/1975 | Mietens | 204/146 |

*Primary Examiner*—T. M. Tufariello

*Attorney, Agent, or Firm*—Richard P. Mueller

[57] ABSTRACT

An improved electrolytic bath composition and process for stripping metal deposits from a different basis metal comprising an aqueous solution containing activating halogen compounds, an amine, nitro and/or nitrate stripping component, and an inhibiting agent to inhibit attack of the basis metal comprising glucoheptonic acid, malic acid, and mixtures thereof as well as the Group IA, IIA and ammonium salts thereof. The stripping of the metal deposit is effected by immersion of the object in the bath while anodically charged and passing electric current through the bath to a cathode for a period of time sufficient to achieve the desired magnitude of stripping of the metal deposit.

21 Claims, No Drawings

ELECTROLYTIC STRIPPING BATH AND PROCESS

BACKGROUND OF THE INVENTION

The present invention is broadly applicable to a solution and method for electrolytically stripping or removing unwanted metallic deposits or platings from substrates, and more particularly, for stripping unwanted metal plating deposits from electroplating apparatus such as the contact tips of work racks as well as for removing defective or damaged metallic platings from ferrous substrates such as steel in order to enable the stripped articles to be replated without incurring any etching or damage to the steel substrate.

In the art of electroplating, it is conventional practice to support work pieces to be plated on a work rack which is comprised of a chemically resistant metal such as titanium or stainless steel or a conventional steel work rack having a protective coating thereover such as a polyvinyl chloride plastisol coating. The electrification of the work pieces while suspended in a suitable electrolyte is achieved by stainless steel or platinumized titanium contact tips on the rack which are connected in electrical contact with the work pieces. During an electroplating operation, an unwanted metal deposit builds up on the contact tips of the work rack which interferes with the efficiency and consistency of the electroplating operation. It is common practice, accordingly, to subject such work racks to mechanical treatment or chemical cleaning treatments in order to periodically remove the unwanted metal deposit accumulation in order to maintain optimum operating efficiency thereof.

The stripping or removal of certain metal deposits is also occasionally required from articles which have been electroplated but wherein the resultant electrodeposit or electroless metal deposit is defective or has become mechanically damaged during handling in order to salvage the article an enable a reprocessing thereof. The stripping or removal of the metal deposit from the surfaces of such articles must be performed in a manner which does not materially etch or damage the underlying substrate to a degree which prevents replating thereof and without requiring substantial polishing and/or buffing operations to restore the substrate surface to a condition in which it can be replated.

In the case of stripping metal deposits from electroplating apparatus such as the contact tips of work racks, it is important that the stripping solution and conditions employed do not materially effect an attack of the contact tips themselves causing a progressive errosion of such contact tips thereby reducing the efficiency of the electroplating operation and necessitating frequent reworking and replacement of such contact tips.

A variety of chemical and electrolytic stripping processes and solutions have heretofore been used or proposed for use for removing unwanted metal deposits of various types from substrates including plated articles as well as contact tips of electroplating apparatuses. Typical of such prior art practices and compositions are those disclosed in U.S. Pat. Nos. 3,492,210; 3,617,456; 3,619,390; 3,649,489; 3,793,172; and 3,912,603. A continuing problem associated with prior art electrolytic stripping formulations and processes has been their inability to effectively strip a wide variety of different metal deposits necessitating separate solutions and processes for the several types of metal deposits to be removed; the relatively slow stripping rate of certain prior art techniques in removing unwanted metal deposits, and the tendency of certain prior art stripping formulations and processes to attack and damage the basis metal during the course of the stripping of the metal deposite therefrom.

The present invention provides for an electrolytic stripping bath and process which is adaptable for rapidly and efficiently stripping a wide variety of metal deposits from a basis metal of different composition and which is inhibited so as to significantly reduce the attack and etching of the basis metal during the stripping operation.

SUMMARY OF THE INVENTION

The benefits and advantages of the present invention are achieved in accordance with the composition aspects thereof, by an aqueous stripping bath comprising an aqueous solution containing activating halogen compounds, a bath soluble amine, nitrate and/or nitro stripping component, hydrogen ions to provide a pH of from about 1 up to about 14, preferably a carboxylic acid buffering agent present in an amount up to about 60 grams per liter (g/l) and an inhibitor to inhibit attack of the basis metal comprising glucoheptonic acid, malic acid and mixtures thereof, as well as the Group IA, IIA and ammonium salts thereof in which the glucoheptonic acid and/or salts thereof are present in an amount of about 1 g/l up to saturation in the bath with amounts of about 5 up to about 20 g/l being usually preferred and the malic acid and/or salts thereof are present in an amount of 1 g/l up to about 20 g/l when used alone and in amounts up to 40 g/l when employed in admixture with the glucoheptonic acid or salts. In the amine-type stripping bath, a controlled effective amount usually ranging from about 30 to about 200 g/l of a primary, secondary and/or tertiary alkyl or alkanol amine containing from $C_1$ to $C_8$ carbons is employed in combination with nitric acid to provide the requisite pH of the stripping bath. In the so-called amine-free type stripping formulation, aqueous soluble organic nitro and/or inorganic nitrates are employed in lieu of the amine and pH adjustment of the operting bath can be effected by nitric acid, acetic acid or the like, as well as alkali metal hydroxides including ammonium hydroxide. It is also contemplated that mixed baths containing both the amine and the organic nitro and/or inorganic nitrate stripping components can be employed. The halogen activating compounds preferably comprise bromine containing compounds which liberate bromine ions to accelerate the stripping action. The glucoheptonic acid inhibiting agent is preferably introduced in the form of an alkali metal salt such as sodium glucoheptonate, for example.

In accordance with the process aspects of the present invention, the stripping of unwanted metal deposits such as copper, bright and semi-bright nickel, sulfamate nickel, cadmium, brass, tin, chromium, and alloys such as iron-nickel alloys, and nickel-phosphorous alloys is effected by immersing an object with the metal deposit thereon in the aqueous stripping solution with the object anodically charged and passing electric current through the bath between a cathode and the object for a period of time sufficient to effect the desired magnitude of stripping of the metal deposit. The aqueous stripping solution can be operated at room temperature (60° F.) up to about 150° F. with temperatures of about 120° to about 140° F. being preferred. The current density during the stripping operation will vary depending upon the resistivity of the basis metal to attack by the stripping solution. In connection with electroplating apparatus such as the contact tips of work racks, for example, which are comprised of a resistant stainless steel alloy such as a type 301 stainless steel or better, current densities of about 100 to about 1500 amperes per square foot (ASF) can be employed, whereas for stripping metal deposits from conventional steel substrates, lower current densities of about 10 to about 300 ASF can satisfactorily be employed.

The inclusion of a controlled effective amount of the inhibiting agent or mixtures of inhibiting agents significantly reduces the corrosion or etching of the basis metal during the stripping process and, surprisingly, has been found to also serve as an activator for stripping iron-nickel alloy deposits which are not effectively stripped employing the same stripping formulation devoid of the inhibiting agent.

Additional benefits and advantages of the present invention will become apparent upon a reading of the description of the preferred embodiments taken in conjunction with the specific examples provided.

DESCRIPTION OF THE PREFERRED EMBODIMENTS

The unexpected effect of the inhibiting agent of the stripping bath and process of the present invention has been observed and demonstrated in both so-called amine-type as well as so-called amine-free type stripping baths. Both of these type electrolytic stripping baths comprise aqueous solutions which can operate at a pH range of about 1 up to about 14 and preferably at a pH of about 5.5 to about 7.5. Generally, the lower the pH, the more rapid is the stripping of the metal deposit. A pH as low as about 1 is commercially impractical because of the difficulty in maintaining such a low pH during bath operation. On the other hand, a pH as high as about 14 is also commercially impractical because of the unacceptable low stripping rate. In accordance with a preferred commercial practice, the stripping bath is maintained at an operating pH of from about 5.5 to about 7.5 when stripping metal deposits from objects composed of a relatively non-resistant ferrous basis metal such as steel, for example. When stripping metal deposits from articles composed of a relatively resistant basis metal, such as stainless steel, for example, a pH range of about 6.5 to about 7.5 is preferred from a commercial standpoint.

Both amine and amine-free type of bath preferably, but not necessarily, contain a buffering agent in an amount usually up to about 60 g/l, preferably 20 to 40 g/l, comprising a carboxylic acid of which acetic acid or alkali metal and ammonium salts thereof constitute the preferred buffering agent. Other suitable carboxylic acid buffering agents include isoascorbic acid, citric acid, succinic acid and the like. While oxalic acid can be employed in some instances, its use is generally undesirable since when stripping nickel platings, nickel oxalate is formed which is substantially insoluble and tends to form excessive sludge in the operating bath. Lactic acid, on the other hand, is usually undesirable due to its tendency to decompose while tartaric acid is undesirable due to its tendency to form excessive sludge. Of the foregoing carboxylic acid buffering agents, acetic acid constitutes the preferred material and can conveniently be introduced as glacial acetic acid.

Both the amine and amine-free type stripping bath contain halogen compounds in controlled amounts to activate the bath and accelerate the stripping of the metal deposits from the basis metal. While fluorine and chlorine containing compounds can be employed to some extent, these halogen materials are too active in some instances and are less desirable than bromine compound activators which possess the requisite activity range for most metal deposits and basis metals. Iodine compounds can also be satisfactorily employed but are less desirable due to their lower activity necessitating the use of higher concentrations than those required employing bromine compounds. The halogen containing activator compounds are selected from organic and inorganic compounds which are soluble in the bath; the halide activator compound, such as the preferred bromine compound may be in the form of the bromide, hypobromite and/or bromate in which the compound on dissolution liberates the corresponding halide rendering it available for activation. The quantity of halide compound employed can be varied depending upon the specific halide used and the type of metal deposit to be stripped in addition to the specific conditions employed during the stripping process and the types and quantities of other constituents present in the stripping bath. Ordinarily, the halide activator compound can be present in amounts up to about 40 g/l calculated as sodium bromide equivalent with amounts of about 8 to about 20 g/l being preferred. When stripping copper metal deposits, no halogen activator or only relatively small amounts are required. However, when stripping metal deposits such as nickel and nickel-iron alloys, for example, the use of a halogen activator compound is necessary to attain satisfactory stripping rates.

In the amine-type stripping bath, in addition to the buffering agent and halogen activating agent, the stripping formulation further contains as a stripping component, an effective amount of an aqueous soluble primary, secondary, tertiary amine or mixtures thereof having a carbon content ranging from about $C_1$ up to about $C_8$ depending on whether the amine is of the primary, secondary or tertiary type. The concentration of the amine in the bath is controlled within conventional prior art practices and typically can range from about 30 to about 200 g/l with the specific concentration established by the type of metal deposit being stripped to attain optimum stripping action. Alkanol amines are particularly preferred because of their solubility in the bath. Typical of the amines that can be satisfactorily employed are those listed in Table 1.

TABLE 1

| |
|---|
| Ethylene Diamine |
| Triethanolamine |
| Isopropanolamine |
| Monoethanolamine |
| Butylamine |
| Hexylamine |
| Diamylamine |
| Diethanolamine |
| Dimethanolamine |
| Triethylamine |
| Tripropylamine |

It will be appreciated that the amine-type stripping bath may also contain variable amounts of organic nitro and/or inorganic nitrate compounds of the same types employed in amine-free baths. When using such a mixture of stripping components, the concentration of the amine stripping component can be correspondingly decreased in consideration of the quantity of the nitrate/nitro compound present to maintain the desired stripping action.

The amine-type stripping bath further contains nitric acid present in an amount to adjust the pH of the electrolytic stripping bath within a range of about 1 to about 14. The presence of the amine in the bath normally provides a pH of about 9 to about 10 and sufficient nitric acid is incorporated to reduce the pH to within the aforementioned range and preferably within a range of about 5.5 to about 7.5 in consideration of any carboxylic acid buffering agent which may also be present.

The amine-free stripping bath contains, in addition to the optional buffering agent and halogen activator compound, a controlled effective amount of bath soluble organic nitro and/or organic nitrate compounds sufficient to attain the desired stripping action. The specific concentration employed will vary depending upon the type of metal deposit to be stripped as well as the resistance of the basis metal to chemical attack. Inorganic nitrate compounds which can satisfactorily be employed comprise the alkali metal and/or ammonium nitrate compounds along with nitric acid itself to adjust the bath within the required pH range. Aqueous soluble organic nitro compounds that can be satisfactorily employed are typically set forth in Table 2.

TABLE 2

Nitrobenzoic Acid
4-Nitroisophthalic Acid
Sodium Nitrobenzoate
Sodium Meta-Nitrobenzene Sulfonate For the electrolytic stripping of metal deposits from relatively resistant basis metals, such as, for example, type 301, type 304 or type 316 stainless steels, the concentration of the nitrate and/or nitro compound can usually range from about 10 up to about 250 g/l calculated as ammonium nitrate or equivalent, with concentrations of about 30 to about 50 g/l being preferred. In electrolytic stripping baths employed for stripping metal deposits such as bright nickel, electroless nickel-phosphorous and copper from conventional steel basis metals, the concentration of the nitrate and/or nitro compound can broadly range from about 80 g/l to about 480 g/l calculated as ammonium nitrate.

In addition to the foregoing constituents, the amine and amine-free electrolytic stripping baths contain as an essential constituent an inhibitor agent for inhibiting attack of the basis metal during the electrostripping process comprising glucoheptionic acid, malic acid and mixtures thereof as well as the Group IA, IIA and/or ammonium salts thereof. The glucoheptionic acid and/or glucoheptonate salt inhibiting agent can be present in an amount of as low as about 1 g/l up to saturation in the stripping bath. Preferably, the glucoheptonic acid and/or glucoheptonate salt inhibiting agent is employed in amounts of about 5 to about 25 g/l. Amounts above about 20 g/l normally do not provide any appreciable benefits over that achieved employing concentrations of about 25 g/l.

Alternatively, the inhibitor agent comprises malic acid as well as the Group IA, IIA and/or ammonium salts thereof which is employed in amounts of about 1 g/l up to about 20 g/l. When the malic-type inhibiting agent is employed as the sole inhibiting agent, concentrations above about 20 g/l have been observed to cause undesirable etching of the basis metal in some instances. In accordance with a preferred practice, the glucoheptonic-type and malic-type inhibitor agents are employed in combination because of an apparent synergistic behavior of such combination on the inhibition of etching of the basis metal in comparison to that obtained by the use of either of these two agents individually. Particularly satisfactory results have been obtained when the weight rates of the glucoheptonic-type agent to malic-type agent ranges from about 1:1 up to about 5:1. When the malic-type inhibitor is employed in combination with the glucoheptonic-type inhibitor, the malic-type inhibitor can be employed in concentrations as high as about 40 g/l.

In the make-up of the electrolytic stripping bath, the halogen activator compound can be conveniently introduced into the bath in the form of a compound of the type and class as set forth in Table 3.

TABLE 3

2-Chloro-5-Nitrosulfonic Acid
N-Chloromethyl Triethyl Ammonium Bromide
Pyridine Allylbromide
2-2', 3-3' Tetrachlorosuccinaldehyde
2-5 Dibromopyridine
Ortho-Chlorophenol
Guanadine Hydrochloride
NaBr
$NaBrO_3$
NaBrO In accordance with the process aspects of the present invention, the amine and amine-free electrolytic stripping bath can be satisfactorily operated at a temperature of about room temperature (60° F.) up to about 150° F. with temperatures of about 120° to about 140° F. being usually preferred. When stripping metal deposits from relatively resistant basis metals, such as a type 301 stainless steel alloy, for example, current densities of from about 100 up to about 1500 ASF can be employed at voltages generally ranging from about 6 up to about 15 volts. Preferably, when stripping the contact tips of work racks for example, comprised of at least a type 301 stainless steel or platinumized titanium basis metal, current densities of about 500 ASF at a voltage of about 10 is preferred. On the other hand, when stripping defective metal deposits from relatively low resistant substrates such as conventional steel, for example, current densities of about 10 up to about 300 ASF can be employed at voltages usually ranging from about 3 up to about 10 volts.

When stripping metal deposits from resistent basis metals, the electrolytic stripping bath of the present invention can satisfactorily be employed for stripping copper, bright and semi-bright nickel, sulfamate nickel, nickel-phosphorous, cadmium, brass, tin, chromium, and iron-nickel alloys. Bright nickel, electroless nickel-phosphorous and copper metal deposits can also be effectively stripped from conventional steel basis metal without adversely corroding or etching the basis metal employing the electrolytic stripping bath of the present invention.

The stripping process is accomplished by immersing the object to be stripped in the electrolytic stripping solution and connecting the object to the anode and passing current through the stripping bath between the object and cathode at the desired current density for a period of time sufficient to effect the desired magnitude of stripping of the metal deposit.

In order to further illustrate the composition and process of the present invention, the following examples are provided. It will be understood that the examples are provided for illustrative purposes and are not intended to be limiting of the scope of the present invention as herein described and as set forth in the subjoined claims.

EXAMPLE 1

An amine-type electrolytic stripping bath suitable for stripping chromium, nickel, nickel-iron alloys, copper, brass, cadmium, zinc and tin from the contact tips of electroplating work racks comprised of a type 301 or 304 stainless steel basis metal is formulated containing 50 to 75 g/l of a aqueous soluble primary, secondary, and/or tertiary aliphatic amine; 20 to 40 g/l of nitric acid; 30 to 50 of glacial acetic acid; 10 to 30 g/l of sodium bromide and 10 to 25 g/l of sodium glucoheptonate. The foregoing stripping solution can be satisfactory employed at temperature of 120 to 140° F., at a pH of 6.5 to 8.0 employing current densities of from 300 to 500 ASF.

EXAMPLE 2

A specific amine-type electrolytic stripping bath suitable for use in accordance with Example 1 is prepared containing 52 g/l isopropanolamine; 20 g/l nitric acid; 20 g/l glacial acetic acid; 24 g/l sodium bromide and 20 g/l of sodium glucoheptonate. The bath is of a pH of 7.5 and a temperature of 140° F.

The effectiveness of the sodium glucoheptonate inhibitor agent in the aforementioned stripping bath is demonstrated by immersing stainless steel coupons of a type stainless steel 301, 304 and 316 in the bath containing different amounts of the inhibiting agent. The test coupon is anodically charged to provide a current density of 500 ASF. The rate of corrosive attack of the solution on the stainless steel basis metal expressed in terms of weight loss in grams per hour (g/hr) is set forth in the following table.

RATE OF ATTACK ON STAINLESS STEEL, g/hr.*

| Concentration, g/l | Stainless Steel Type | | |
|---|---|---|---|
| Sodium Glucoheptonate | 301 | 304 | 316 |
| 0 | 0.087 | 0.037 | 0.008 |
| 10 | 0.028 | 0.010 | 0.000 |
| 20 | 0.025 | 0.008 | 0.000 |

*g/hr. based on 2 square inches surface area of test coupon

EXAMPLE 3

An amine-free electrolytic stripping bath suitable for stripping metal deposits as described in Example 1 from the contact tips of electroplating work racks is prepared containing 40 to 80 g/l ammonium nitrate; 10 to 40 g/l ammonium acetate; 5 to 15 g/l sodium bromide; and 5 to 25 g/l sodium glucoheptonate. This bath is particularly effective stripping metal deposits from contact tips when employed at a current density of 300 to 600 ASF at a pH of 6.5 to 7.5 and at a temperature ranging from 120 to 140° F.

EXAMPLE 4

An amine-free electrolytic stripping solution of the type described in Example 3 is prepared containing 35 to 45 g/l ammonium nitrate; 15 to 25 g/l ammonium acetate; 9 to 10 g/l sodium bromide and 5 to 10 g/l sodium glucoheptonate. The bath is operated at a temperature of 120° F. at a pH of 7.5 and stainless steel test coupons of types 301, 304 and 316 stainless steel are immersed in the bath and anodically charged to provide an average current density of about 500 ASF. The rate of attack as measured by the weight loss of the test coupons in terms of grams per hour is set forth in the following table.

RATE OF ATTACK ON STAINLESS STEEL, g/hr.*

| Concentration, g/l | Stainless Steel Type | | |
|---|---|---|---|
| Sodium Glucoheptonate | 301 | 304 | 316 |
| 0 | 0.070 | 0.047 | 0.005 |
| 10 | 0.019 | 0.013 | 0.000 |
| 20 | 0.003 | 0.003 | 0.000 |

*g/hr. based on 2 square inches surface area of test coupon

EXAMPLE 5

An amine-free electrolytic stripping bath suitable for stripping bright nickel, electroless nickel-phosphorous and copper metal deposits from a low alloy steel basis metal is prepared containing 80 to 480 g/l ammonium nitrate; 1 to 10 g/l sodium glucoheptonate; 1 to 10 g/l sodium bromide; and 5 to 10 g/l malic acid. The bath can satisfactorily be operated at a temperature of from 80° F. to 120° F., a pH of 4.5 to 7.5 and a current density of 25 to 200 ASF.

EXAMPLE 6

An amine-free electrolytic stripping bath of the type described in Example 5 suitable for stripping bright nickel, copper, nickel-phosphorous, tin, brass and cadmium from mild steel substrates is prepared containing 240 to 320 g/l ammonium nitrate; 5 to 10 g/l sodium bromide; 10 to 20 g/l sodium glucoheptonate and 5 to 10 malic acid. The bath can satisfactorily be operated at about 100° F. at a pH ranging from 4.5 to 7 and at current densities of 10 to 200 ASF.

EXAMPLE 7

The dramatic inhibiting effect of the inhibitor agent of the stripping compositions of the present invention is further demonstrated by comparative tests between a control solution devoid of any inhibiting agents in comparison to stripping compositions incorporating 10 g/l of malic acid or 10 g/l of sodium glucoheptonate. The control stripping bath designated as (a) is prepared to contain 240 g/l of ammonium nitrate, 5 g/l of sodium bromide and the pH is about 6.0. The bath is controlled at a temperature of about 90° F. Polished mild steel test coupons having a surface area of 8.8 square inches are immersed in the stripping bath for a period of sixty minutes and are anodically charged at an average current density of about 100 ASF. At the completion of the one hour test period, the test coupons are removed and weighed to determine weight loss in terms of grams per hour and percent of original weight.

A test solution embodying the present invention and designated as bath (b) is prepared having the same composition as bath (a) but further incorporating 10 g/l malic acid and the pH is adjusted to about 6.0 by the addition of ammonium hydroxide to offset the acidity of malic acid. Similarly, a bath designated as (c) is prepared having a composition identical to bath (a) but further incorporating 10 g/l of sodium glucoheptonate. Similar test coupons are immersed in bath (b) and (c) for a period of one hour under the same conditions and temperature as employed in connection with bath (a).

The dramatic reduction in weight loss of the test coupons is set forth in the following table.

| RATE OF ATTACK ON MILD STEEL TEST COUPON | | |
|---|---|---|
| Stripping Bath | Weight Loss of Test Specimen | |
| | g/hour | %/hour |
| (a) | 0.056 | 0.0064 |
| (b) | 0.012 | 0.0007 |
| (c) | 0.004 | 0.00005 |

The data provided in the tables of Examples 2, 4 and 7 clearly demonstrate the unexpected effectiveness of the presence of the inhibiting agent in reducing corrosive attack or etching of the basis metal. The data presented in Example 7 evidences the use of as little as 10 g/l of either of the inhibiting agents, as preventing significant etching of mild-steel ferrous substrates enabling the stripping of defective platings from parts and permitting a replating thereof without damage to the substrate.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. An electrolytic stripping bath for stripping metal deposits from a different basis metal comprising an aqueous solution having a pH of about 1 to about 14 and containing a halogen compound in an amount sufficient to activate the bath, a stripping component selected from the group consisting of (a) a bath soluble primary, secondary and/or tertiary amine having a carbon content of $C_1$ to $C_8$, (b) a bath soluble inorganic nitrate and/or organic nitro compound and mixtures of (a) and (b), and an inhibiting agent present in an effective amount to inhibit attack of the basis metal comprising a compound selected from the group consisting of glucoheptonic acid, malic acid, and mixtures thereof as well as the Group IA, IIA and ammonium salts thereof.

2. The stripping bath as defined in claim 1 further including a carboxylic acid buffering agent present in an amount up to about 60 g/l.

3. The stripping bath as defined in claim 1 further including a carboxylic acid buffering agent present in an amount of about 20 to about 40 g/l.

4. The stripping bath as defined in claim 2 wherein the carboxylic acid buffering agent is acetic acid.

5. The stripping bath as defined in claim 1 in which said inhibiting agent comprises glucoheptonic acid, the Group IA, IIA and ammonium salts thereof present in an amount of about 1 g/l up to saturation.

6. The stripping bath as defined in claim 5 in which said inhibiting agent is present in an amount of about 5 to about 25 g/l.

7. The stripping bath as defined in claim 1 in which said inhibiting agent comprises malic acid, the Group IA, IIA and ammonium salts thereof present in an amount of about 1 to about 20 g/l.

8. The stripping bath as defined in claim 1 in which said inhibiting agent comprises a mixture of at least one of (c) glucoheptonic acid, a Group IA, IIA and ammonium salt thereof; and at least one of (d) malic acid, a Group IA, IIA and ammonium salt thereof in which (c) is present in an amount of about 1 g/l up to saturation and (d) is present in an amount of about 1 g/l to about 40 g/l.

9. The stripping bath as defined in claim 8 in which the weight ratio of (c) to (d) in the bath ranges from about 1:1 up to about 5:1.

10. The stripping bath as defined in claim 1 in which said halogen compound comprises a bromine compound present in an amount up to about 40 g/l calculated as sodium bromide.

11. A process for electrolytically stripping metal deposits such as copper, bright and semi-bright nickel, sulfamate nickel, nickel-phosphorous, cadmium, brass, tin, chromium and iron-nickel alloys from a different basis metal which comprises the steps of immersing an object to be stripped in a stripping bath comprising an aqueous solution having a pH of about 1 to about 14 and containing a halogen compound in an amount sufficient to activate the bath, a stripping component selected from the group consisting of (a) a bath soluble primary, secondary and/or tertiary amine having a carbon content of $C_1$ to $C_8$, (b) a bath soluble inorganic nitrate and/or organic nitro compound and mixtures of (a) and (b); and an inhibiting agent present in an effective amount to inhibit attack of the basis metal comprising a compound selected from the group consisting of glucoheptonic acid, malic acid, and mixtures thereof as well as the Group IA, IIA and ammonium salts thereof; anodically charging the object and passing electric current through the solution to a cathode for a period of time to achieve the desired magnitude of stripping of the metal deposit from the object.

12. The process as defined in claim 11 including the further step of controlling the temperature of said stripping bath within a range of about 60 to about 150° F.

13. The process as defined in claim 11 in which the step of passing electric current through the solution to a cathode is carried out at a current density ranging from about 25 to about 1500 ASF.

14. The process as defined in claim 11 including the further step of controlling the pH of said bath between about 5.5 and 7.5.

15. The process as defined in claim 11 in which said inhibiting agent comprises glucoheptonic acid, the Group IA, IIA and ammonium salts thereof present in an amount of about 1 g/l up to saturation.

16. The process as defined in claim 15 in which said inhibiting agent is present in an amount of about 5 to about 25 g/l.

17. The process as defined in claim 11 in which said inhibiting agent comprises malic acid, the Group IA, IIA and ammonium salts thereof present in an amount of about 1 to about 20 g/l.

18. The process as defined in claim 11 in which said inhibiting agent comprises a mixture of at least one of (c) glucoheptonic acid, a Group IA, IIA and ammonium salt thereof; and at least one of (d) malic acid, a Group IA, IIA and ammonium salt thereof in which (c) is present in an amount of about 1 g/l up to saturation and (d) is present in an amount of about 1 to about 40 g/l.

19. The process as defined in claim 18 in which the weight ratio of (c) to (d) in the bath ranges from about 1:1 up to about 5.1.

20. The process as defined in claim 11 wherein the stripping bath also contains a carboxylic acid buffering agent present in an amount up to about 60 g/l.

21. The process as defined in claim 20 wherein the carboxylic acid buffering agent is acetic acid.

* * * * *